United States Patent [19]

Ekstroem

[11] 4,083,207

[45] Apr. 11, 1978

[54] APPARATUS FOR THE WET TREATMENT OF TEXTILE MATERIALS

[76] Inventor: Carl Lennart Ekstroem, Soermarksilden 21, Boras, Sweden

[21] Appl. No.: 703,804

[22] Filed: Jul. 9, 1976

[30] Foreign Application Priority Data

Jul. 15, 1975 Germany ..... 2531610

[51] Int. Cl.[2] ..... D06B 3/24

[52] U.S. Cl. ..... 68/178; 366/154; 366/338

[58] Field of Search ..... 68/177, 178, 62, 175, 68/181 R, 184, 200, 205 R, 207, 212, DIG. 1; 8/152, 151.2; 28/1.4; 118/405, 419, 420; 134/64 R, 64 P, 122 R, 122 P, 182, 183, 9, 15; 57/34 B; 259/4 R, 4 A, 4 AB, 4 AC; 354/321, 322, 324

[56] References Cited

U.S. PATENT DOCUMENTS

| | | | |
|---|---|---|---|
| 2,645,463 | 7/1953 | Stearns | 259/4 AC |
| 2,783,609 | 3/1957 | Breen | 57/34 B |
| 2,924,000 | 2/1960 | Griset et al. | 28/1.4 |
| 3,346,893 | 10/1967 | Carpenter | 68/181 R X |
| 3,458,987 | 8/1969 | Ozawa et al. | 28/1.4 X |
| 3,670,531 | 6/1972 | Thies et al. | 68/178 X |
| 3,952,558 | 4/1976 | Sandberg et al. | 68/177 |

*Primary Examiner*—Philip R. Coe

[57] ABSTRACT

The invention relates to apparatus for the wet-treatment of textile materials particularly in endless web or rope form whether as yarn or made-up. Wet-treatment liquid, particularly dye liquor is introduced into a driving nozzle through which the rope passes through a feed pipe having internal baffles arranged preferably in a helical formation.

6 Claims, 7 Drawing Figures

APPARATUS FOR THE WET TREATMENT OF TEXTILE MATERIALS

BACKGROUND OF THE INVENTION

This invention relates to apparatus for the wet treatment of textile materials in endless web or rope form, particularly but not exclusively for the dyeing of textile materials.

There are numerous types of so-called jet dyeing machines which are primarily used for dyeing textiles. In these machines an endless rope of between 600 and 1500 m, in length, varying in accordance with the weight of the material or its quality, is passed through a pressurised vessel in a closed path, the driving nozzle firstly being used for injecting the treating medium and secondly for moving the rope. Generally so-called dwell zones for the rope are provided in the lower part of the vessel which is used for the wet treatment, and in these the textile material is layered and rests there for a period until it is driven forward again by the feed means. To achieve a uniform wet treatment, and in particular a uniform dyeing of the textiles — and this applies particularly to textile goods in the length — the goods must also be lowered in the zone of the nozzle or immediately thereafter without any hindrance. Whereas this is not difficult in so-called light goods or even goods in the form of yarn, it has been found that in the case of goods with a weight of 300 - 600 g per meter the layering does not take place without hindrance. This is particularly true for example of cloth or the like.

BRIEF SUMMARY OF THE INVENTION

It is an object of this invention to improve the layering in the zone of the nozzle even in the case of heavy or thick textile materials.

The invention therefore provides apparatus for the wet treatment of textiles in web or rope form comprising a treatment vessel, a driving nozzle mounted within said vessel, a feed pipe for treatment liquid communicating with the driving nozzle, and at least one baffle secured on an internal surface of the feed pipe to cause swirling of the treatment liquid supplied through said feed pipe to the nozzle.

Conveniently the feed pipe is arranged at right-angles to the axis of the driving nozzle.

It has been found that if the stream of treating liquid is caused to eddy before entering the nozzle the goods in the nozzle and immediately downstream from this are automatically layered in effective fashion — even in the case of so-called heavy textile material by the length — and that the rolling-in at the edge of the textile goods is combated, so that even the marginal areas of the textile length of the material can be subject to the wet treatment without hindrance. This prevents shadowing or un-uniform dyeing even in the case of so-called heavy textile material by the length.

The baffles can be arranged in helical form, and may be inclined relatively to the cross sectional plane of the feed pipe.

If a three-dimensional inclination is envisaged, the baffles can be arranged as parts of a kind of propeller blade. In a construction of blade-like projections of this kind, the treatment liquid is given a spiral rotation or twisting before entering the driving nozzle so that this has a direct spiralling effect on the rope even in the driving nozzle itself, and hence the rope "twists" in the driving nozzle. Thus in a very simple way the advantages set out above in relation for example to the dyeing even of the marginal areas of particularly heavy textile materials by length can be achieved.

It is also feasible that the baffles can be combined into at least one helical strip which is attached to the inner side of the pipe. This strip can be inclined towards the centre of the pipe.

Another embodiment lies in the arrangement whereby the baffles are composed of rod-like members, pins, bolts or the like, which are secured individually in the interior of the feed pipe.

BRIEF DESCRIPTION OF THE DRAWINGS

There will now be given, with reference to the accompanying drawings, a detailed description of examples of apparatus according to the invention. It will be understood that the description is given by way of example only and not by way of limitation.

In the drawings.

DETAILED DESCRIPTION OF THE DRAWINGS

Figure 1:
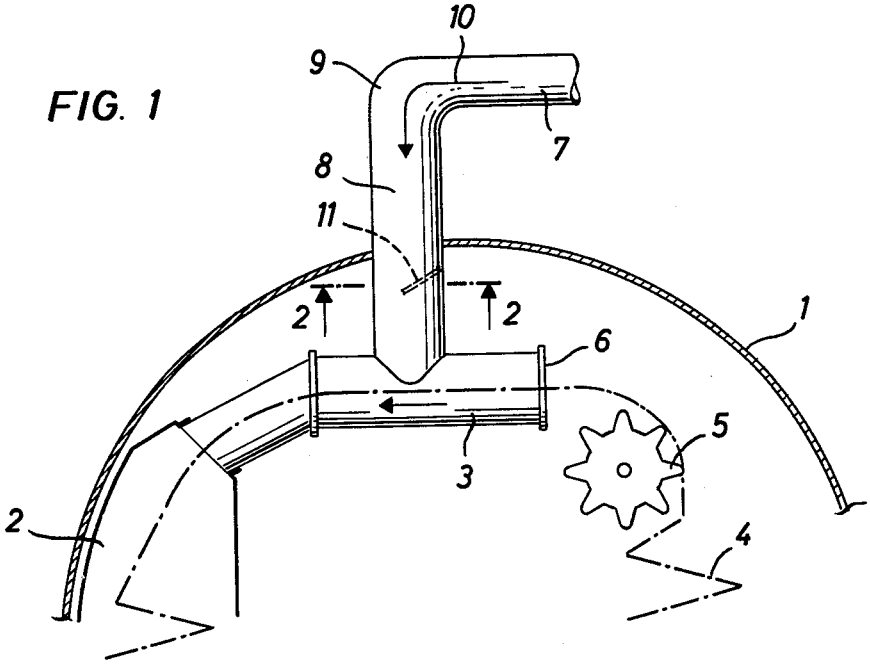
FIG. 1 is a diagrammatic sectional view through a part of a machine for the wet handling of a textile rope.

A pressure vessel 1 which may for example be installed in a rope dyeing machine is equipped with a stirrup-shaped dwell chamber 2 (shown in part) which extends to the lower rim of the cylindrical vessel 1.

Textile material, for example textile fabric by length forwarded by a driving nozzle 3 is layered in the dwell chamber 2; this dwell chamber generally contains the same liquid injected by the driving nozzle 3.

The textile rope 4 is brought to the mouth 6 of the driving nozzle by a winch 5.

The driving nozzle is supplied with the wet-treatment liquid through a pipe 7 to which a feed pipe 8 is directly connected.

The feed pipe 8 generally has a length of only 15 - 50 cm, since the overall height of the machine is determined by the pipe elbow 9.

Figure 2:
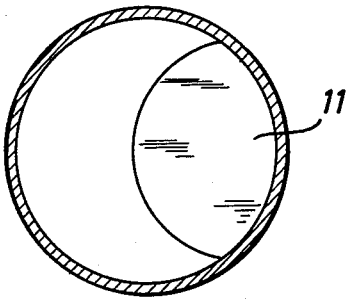
FIG. 2 is a section on the line 2 — 2 of FIG. 1.
Figure 3:
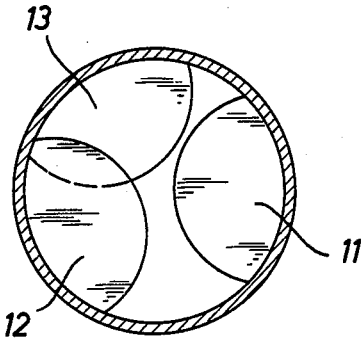
FIG. 3 is a section similar to that of FIG. 2 but through a modified example of the invention.

The treating liquid introduced in the direction of arrow 10 impinges against a baffle in the form of a blade-like projection 11, which is firmly secured to the inner side of the pipe and inclined in the direction of flow of the medium, as seen in FIG. 1. The blade-like projection 11, as shown in FIG. 2, is of semi-circular shape so that the cross-section area of the feed pipe 8 is reduced in the region of this blade and at the same time is deflected in a particular direction by virtue of the inclination of the latter. In order to make this deflection into a twisted or helical form in a predetermined direction, blades of the kind illustrated in FIG. 2 can be arranged in staggered sequence in the feed pipe 8 so that the feed liquid deflected by the blade 11 impinges first against a blade projection 12 and finally on a blade projection 13. In the particular arrangement of the blade-like projections 11 to 13, which are identical, but are arranged one below another and are staggered in a helical fashion, a partial eddying effect is produced. This eddy effect is increased if the blades are suitably inclined in relation to the cross sectional plane concerned.

Figure 4:
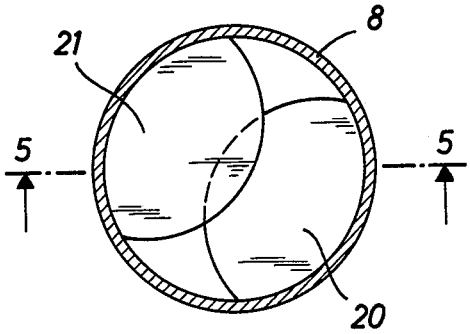
FIG. 4 is a section similar to that of FIG. 2 through a further modified example of the invention.
Figure 5:
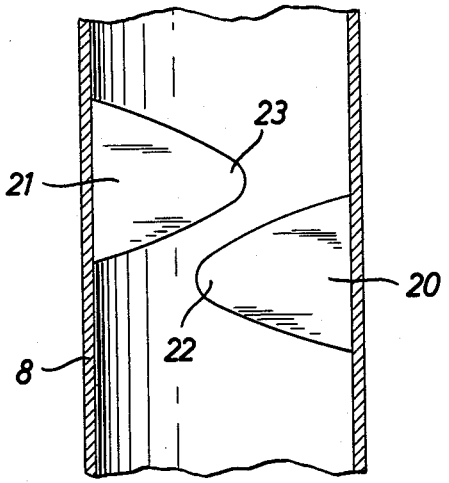
FIG. 5 is a section on the line 5 — 5 of FIG. 4, and FIGS. 6 and 7 are sections through two further modified examples of the invention.

A good eddy or vortex effect is produced by the arrangement illustrated in FIGS. 4 and 5. These blades 20, 21, are connected to one another in a propeller-type arrangement in the feed pipe 8. The arrangement is designed so that the tips 22, 23 overlap in each case.

It will be understood that other propeller blade-like projections could be used. The construction of these blade projections will generate a particularly good spiral twisting of the treating medium directly upstream of the driving nozzle; for this reason the construction is particularly suitable for heavy textile material in the length, for example having a weight of 500 – 600 g per meter.

Figure 6:
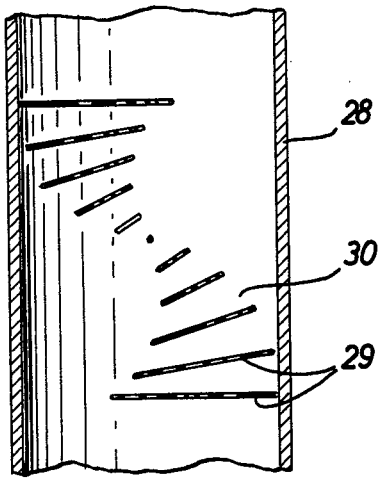

In the arrangement illustrated in FIG. 6 rod-like projections in the form of pins 29 project into the interior of the feed pipe 28 and are so arranged that their attachment points form a spiral 30 within the pipe; this also imposes spiral twisting on the treating liquid, especially as the pins are such a small distance from one another that only a small part of the treating medium can pass between them.

Figure 7:
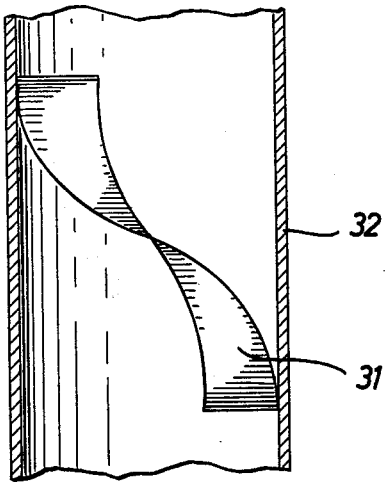

The arrangement illustrated in FIG. 7 caters for a positive twisting of the treating and feed medium. A helical strip 31 of metal or plastics material is secured to the inside wall of the feed pipe and is connected at one side to the pipe in a helical path corresponding to that of the pins mentioned above, but is also relatively inclined in the feed direction. This is not however an essential feature. The width of the strip 31 may taper in one sense or the other towards the driving nozzle. The width of the strip can be less than the radius of the feed pipe 32, but this is not essential.

It has been found that, in some circumstances, the most effective spiralling of the flow of treating medium is achieved with the example shown in FIG. 7. It will be understood that a plurality of strips in spiral form, may be distributed over the innner wall of the feed pipe.

I claim:

1. An apparatus for the wet treatment of textiles in web or rope form, comprising (a) a treatment vessel having an interior chamber for holding textiles;

(b) a nozzle positioned in said treatment vessel above said interior chamber and having an axis with an inlet thereon adapted for receiving said textiles and an outlet; and (c) mechanical feeding means for transporting said textiles to said nozzle inlet; and (d) a treatment liquid feed pipe connected to said nozzle at substantially right angles to said nozzle axis, said feed pipe having a plurality of baffle means, attached to its inner surface in staggered sequence, for creating a helical flow path of said treatment liquid at the feed pipe and nozzle connection.

2. The apparatus of claim 1, wherein said baffle means comprise blade-like projections.

3. Apparatus as claimed in claim 2, wherein there are provided at least two separate blade-like projections, arranged in said staggered sequence along said internal surface of said feed pipe in a helical path in the direction of the flow of said treatment liquid.

4. The apparatus of claim 1, wherein said baffle means comprise two baffles, each mounted on said feed pipe internal surface at an angle inclined in relation to the cross-sectional plane of said feed pipe.

5. The apparatus of claim 1 wherein said plurality of baffle means comprise an elongated strip secured along the internal surface of said feed pipe in a helical path.

6. The apparatus of claim 1 wherein said baffle means comprise a plurality of rods attached to said feed pipe inner surface along a helical path.

* * * * *